United States Patent [19]

Shorkey

[11] Patent Number: 4,673,893

[45] Date of Patent: Jun. 16, 1987

[54] AUDIO OSCILLATOR OUTPUT DEVICE WITH PRESSURE SENSITIVE ADVANCE MECHANISM

[76] Inventor: David Shorkey, 835 Lakewood Ave., Schenectady, N.Y. 12309

[21] Appl. No.: 806,387

[22] Filed: Dec. 9, 1985

[51] Int. Cl.[4] ..... G08B 23/00

[52] U.S. Cl. ..... 331/64; 340/323 R

[58] Field of Search ..... 331/64, 179; 340/384 R, 340/323 R; 381/98; 441/55

[56] References Cited

U.S. PATENT DOCUMENTS 3,893,099 7/1975 Zoepfl ..... 340/323 R 4,285,041 8/1981 Smith ..... 340/323 R X

*Primary Examiner*—Eugene R. LaRoche

*Assistant Examiner*—Robert J. Pascal

[57] ABSTRACT

A waterproof audible sound producing device for use by swimmers to adjust their stroke rate. A frequency control moves through a spectrum of frequencies on an incremental basis when a signal is received from a pressure sensitive signaling button. A slide switch allows the user to choose between at least two sets of frequencies and each set of frequencies contains less than five discrete frequencies and a zero output where there is no audible sound produced.

6 Claims, 4 Drawing Figures

AUDIO OSCILLATOR OUTPUT DEVICE WITH PRESSURE SENSITIVE ADVANCE MECHANISM

FIELD OF THE INVENTION

Generally, this invention relates to an audio oscillator output such as a metronome. More specifically, this invention relates to such a device with a pressure sensitive advance mechanism and appropriate for use by swimmers.

BACKGROUND AND OBJECTS OF THE INVENTION

Of common knowledge is the fact that rhythm plays an important part in a variety of activities, from the playing of music to athletics. For example, in sculling having a consistent number of strokes per minute by the various oarsmen is of such importance that the weight of another individual is warranted solely for the purpose of maintaining timing.

In the sport of competitive swimming, research into stroke rates (hereinafter "S") has shown some very interesting relationships between velocity ("V"), the stroke rates and the amount of distance the swimmer moves through the water during each stroke cycle (hereinafter "D/S"). Applying these concepts to competitions during the 1976 U.S. Olympic trials, it was determined that for most swimmers, an increase in "S" and a decrease in "D/S" would result in a greater "V".

Further studies have shown that while a similar "V" can be obtained when the "D/S" is longer and the "S" is slower, such a variation is difficult to maintain. This is due to the fact that in order to obtain a greater distance per stroke, the individual must apply a greater force during the stroke cycle. The application of this great force causes muscle fatigue with the result being an overall increase in the swimmer's time.

While it appears that most swimmers would benefit by an increase in their stroke rate, there is obviously a point wherein the reduction in distance per stroke in order to increase the stroke rate will begin to reduce the velocity. Thus, it is necessary for the swimmer to attempt to maintain the most effective stroke rate and force, or distance per stroke, in order to maximize velocity. All of these factors are subject to variations depending upon the amount of distance to be covered. In many situations it may also be advantageous for the stroke rate to vary during the competition. For example, it may be beneficial for the swimmer to apply a higher stroke rate initially in order to move ahead of the competition and avoid the turbulence caused by the other swimmers. For the main segment of the race, a more moderate steady pace may be desirable followed by a fast stroke rate at the finish which would be comparable to a runner's final kick when approaching the finish line.

When initially training swimmers, it is therefore important for them to learn how to vary velocity by adjusting their stroke rate and their distance per stroke in order to compete effectively. Once a swimmer has accomplished this, a certain approach or strategy may be applied, depending upon the length and characteristics of a particular race. Since "D/S" is directly related to the force applied during each stroke, it is generally easier for the swimmer to vary velocity by adjusting the stroke rate.

With the recent increase in triathlons, a greater and greater number of individuals are training for swimming competitions. However, although they can improve by studying various stroke techniques and through practice, they are generally unable to achieve and maintain their preferred stroke rate for maximum velocity. The result being that they either expend too much energy too early, or else hold back more than is necessary during the competition.

It is therefore an object of this invention to provide a new and improved audio oscillator output means, such as a metronome, which may be used by swimmers.

Another object of this invention is to provide a new and improved audio oscillator output which may be adjusted without visual engagement.

Another object of this invention is to provide an audio oscillator output means which may be used by a swimmer to pace the race.

Another object of this invention is to provide a new and improved audio oscillator output means which may be moved through a predetermined sequence of frequencies in order to allow the swimmer to adjust the pace.

Objects and advantages of the invention are set forth in part herein and in part will be obvious herefrom, or may be learned by practice with the invention, the same being realized and attained by means of the instrumentalities and combinations pointed out in the appended claims.

The invention consists in the novel parts, constructions, arrangements, combinations and improvements herein shown and described.

SUMMARY OF THE INVENTION

It has been found that the object of this invention may be realized by forming a waterproof metronome which has an impact sensitive advance mechanism for moving through the spectrum of a predetermined set of frequencies. A selector allows the user to chose between alternate frequencies sequences depending upon the users ability and the type of stroke being performed. Advantageously, the sequence for each set of frequencies is cyclical and each set includes an increment in the sequence which corresponds to a zero output.

The metronome of this invention provides a remarkably versitile and easy to use method for swimmers to adjust their stroke rate. Since the advance mechanism is pressure sensitive a swimmer wearing the device near the ear can easily advance through the sequence of frequencies without significantly altering the swim stroke. Consequently, the swimmer may become accumstomed to strategically changing stroke rates during a race in order to obtain the greatest average velocity possible.

It will be understood that the foregoing general description and the following detailed description as well are exemplary and explantory of the invention but are not restrictive thereof. Thus, while this invention is particularly adapted for use by swimmers, the principles underlying the invention are not limited to such usage, but are equally applicable, for example, in running, calisthenics, or any other activity requiring a certain rhythm or timing.

The accompanying drawings, referred to herein and constituting a part hereof, illustrate preferred embodiments of the invention, and together with the description serve to explain the principles of the invention.

DESCRIPTION OF THE PREFERRED EMBODIMENTS

Figure 1:
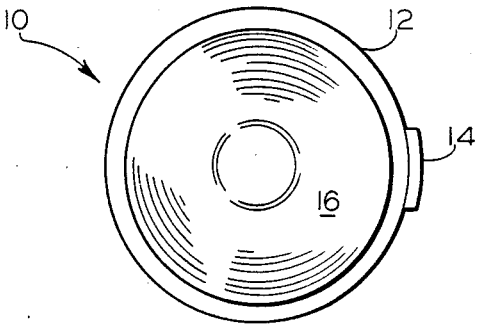
FIG. 1 is a top plan view of the invention.

FIG. 1 discloses the metronome generally designated as 10. The metronome has a body portion 12.

It should be appreciated that the actual inner workings of the metronome may be formed in any one of a variety of arrangements which are well known in the art. Examples of possible circuitry are disclosed in the Kliner U.S. Pat. No. 3,901,121 or the Landuyt U.S. Pat. No. 3,675,243. Similarly, the audible sound produced by the metronome may be of various intensities and will not be described herein. However, since the actual circuitry is not considered to be significant with regard to the workings and patentability of this invention the actual pattern will not be discussed herein.

Figure 2:
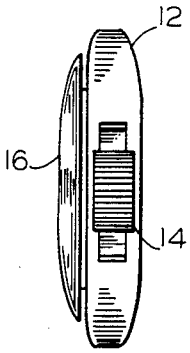
FIG. 2 is a side elevational view of the invention showing the pressure sensitive advance mechanism and the frequency selector switch.

FIG. 2 discloses the switch 14 which in my preferred embodiment is used to select between alternate sequences of frequencies. In my preferred embodiment there is a high mode which emits 40, 46 and 51 beats per minute and an alternate low mode which emits 27, 33 and 40 beats per minute. For easier use, the frequency sequences overlap as shown here at 40 beats per minute. It will be appreciated by those familiar with this field that the high mode would be most appropriate for short distances and/or expert swimmers while the low mode would be more appropriate for longer distances and/or intermediate swimmers. In addition to the three increments disclosed for each sequence there is an additional increment which corresponds to a zero output or off mode. For ease in use each sequence is cyclical with the zero output being between the highest and lowest beats per minute in the sequence.

It should be appreciated that other frequencies could be chosen or that a greater number of frequencies could be used without rendering movement through the sequence overly burdensome. However, I have found it preferable to use less than five frequencies per sequence in order to avoid confusion. The above increments in each sequence were derived by analyzing the stroke rates for freestyle, breast stroke, back stroke and butterfly and setting frequencies which accurately reflected the most likely range of stroke rates.

FIG. 2 also discloses the advance button 16 which is preferrably a solid state pressure sensitive switch that serves to advance through each increment in the frequency sequences disclosed above. The advance button 16 encompasses most of the side of the body 12 so that it may be easily contacted during swimming should it be desirable to change the frequency. The advance button 16 may change the frequency by a number of methods. For example, it may ratchet a variable inductor or trimmer capacitor through several discrete positions, thereby altering the basic inductive/capacitive constant of an oscillator circuit. In an embodiment utilizing a multivibrator type of oscillator, the advance button may actuate a rotary selector which chooses one of several discrete crystals which, in turn, act as a source of synchronizing pulse(s) to the basic multivibrator circuit.

In the subject invention, when pressed, the advance button 16 sends a stimulation signal to the incremental frequency control to move to the next step in the sequence.

Figure 3:
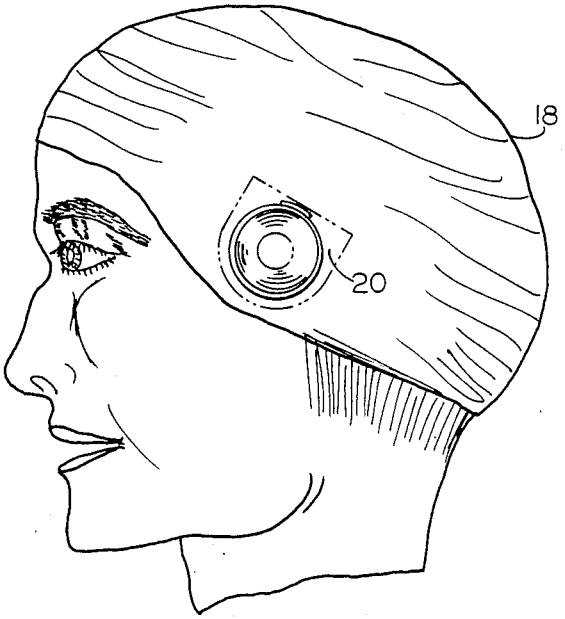
FIG. 3 shows a possible application of the invention.

FIG. 3 discloses one mode for holding the metronome 10. In this embodiment a swim cap 18 is formed with a pocket 20 substantially close to the users ear. In this configuration the metronome 10 may be simply placed within the pocket with the advance button 16 facing outwardly for easy contact.

Figure 4:
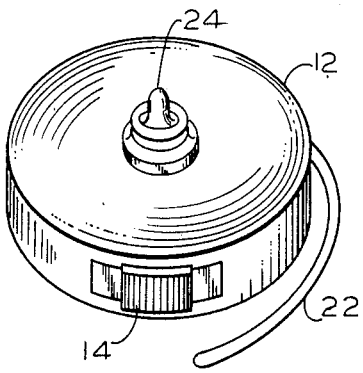
FIG. 4 is a perspective view showing an alternate embodiment of the invention.

FIG. 4 shows an alternate embodiment wherein a hook 22 secured to the body 12 may simply be placed over the ear and an ear plug 24 on the side of the body opposite to the advance button would fit within the ear. This mode of attachment would be preferrable where the invention is being used for a sport other than swimming.

Where the invention is in fact used for swimming it would obviously be waterproof and be relatively impact resistent.

In operation, the user chooses the desired set of frequencies with slide switch 14. The invention is either slipped into a pocket 20 of the swimcap 18 or else secured to the users ear by means of hook 22. The application of pressure to the advance button 16 will advance the frequency control from zero to the next increment. Futher applications of pressure will move through the set of frequencies and back to a zero output wherein the cycle may be started again.

The invention in its broader aspects is not limited to the specific embodiments herein shown and described but departures may be made therefrom within the scope of the accompanying claims, without departing from the principles of the invention and without sacrificing its chief advantageous.

I claim:

1. An audible timing device for athletic activities comprising:

an audio oscillator output means for generating an audible sound at a predetermined set of frequencies within a spectrum;

an incremental frequency control for advancing the audio oscillator output through a sequence of discrete frequencies, said frequency control adapted to increase from one frequency to the next through the frequency spectrum when stimulated;

a pressure sensitive depressable signaling mechanism which sends a stimulation signal to the frequency control upon each application of a direct straight pushing force sufficient to depress the mechanism whereby the frequency is advanced through its predetermined sequence.

2. The invention of claim 1 wherein one increment in said sequence corresponds to a zero output and the sequence is cyclical.

3. Invention of claim 2 further comprising:

an alternate sequence of frequencies; and selection means for choosing said first or alternate sequence.

4. The invention of claim 2 wherein there are less than five frequencies per sequence.

5. The invention of claim 1 wherein one side of the device is adapted to lie against the users ear and a button which serves as the signaling mechanism substantially covers the other side of the device.

6. The invention of claim 5 further comprising a swim cap having a pocket adapted to lie over one of the wearers ears, said pocket adapted to receive the timing device so as to hold said device in place by the users ear and allow for frequency advancements.

* * * * *